United States Patent [19]

Cabal et al.

[11] 4,178,226

[45] Dec. 11, 1979

[54] COMPATIBLE MIXTURES OF COAL LIQUIDS AND PETROLEUM BASED FUELS

[75] Inventors: Albert V. Cabal, Woodbury; Joseph G. Bendoraitis, Pitman; Robert B. Callen, West Deptford; Robert T. Pavlica, Princeton, all of N.J.; Sterling E. Voltz, Media, Pa.

[73] Assignee: Electric Power Research Institute, Inc., Palo Alto, Calif.

[21] Appl. No.: 787,803

[22] Filed: Apr. 15, 1977

[51] Int. Cl.[2] ..... C10L 1/04

[52] U.S. Cl. ..... 208/15

[58] Field of Search ..... 208/15

[56] References Cited

U.S. PATENT DOCUMENTS

| | | | |
|---|---|---|---|
| 65,866 | 6/1867 | Bassett | 208/15 |
| 1,567,235 | 12/1925 | Butler et al. | 208/15 |
| 1,583,573 | 5/1926 | Butler et al. | 208/15 |
| 1,963,589 | 6/1934 | Miller | 208/15 |
| 2,909,483 | 10/1959 | Williams et al. | 208/15 |
| 3,533,938 | 10/1970 | Leas | 208/15 |
| 3,536,608 | 10/1970 | Reidl et al. | 208/10 |
| 3,540,995 | 11/1970 | Wolk et al. | 208/10 |

OTHER PUBLICATIONS

"The Flash Pyrolysis of Solid Wastes" by C. S. Finney et al., Energy Sources, vol. 1, No. 3 (1974), pp. 295–314.

*Primary Examiner*—O. R. Vertiz
*Assistant Examiner*—Wayne A. Langel
*Attorney, Agent, or Firm*—Bertram I. Rowland

[57] ABSTRACT

Enhanced compatibility of coal liquids with petroleum based fuels is achieved by removing or modifying the 950° F. plus asphaltene-containing fraction of the coal liquid. The separation or modification can be achieved by distillation, deasphalting, hydroprocessing, and the like.

5 Claims, No Drawings

COMPATIBLE MIXTURES OF COAL LIQUIDS AND PETROLEUM BASED FUELS

This invention was made under contract with or supported by the Electric Power Research Institute, Inc. of Palo Alto, Calif.

BACKGROUND OF THE INVENTION

Field of the Invention

The potential use of coal as a source of liquid fuel has greatly increased as the scarcity and price of petroleum increases. For many potential uses of the coal liquids, it will be necessary or desirable to blend the coal liquid with petroleum fuels. Therefore, compatability of the coal liquid with the petroleum fuel is important. Otherwise, upon combining coal liquids and petroleum fuels, it will be necessary to process the mixture to insure that precipitates and gummy solids are not formed which may interfere with the use of the fuel mixture. In addition, coal liquids may be transported through existing petroleum pipelines. Any incompatabilities with small amounts of petroleum products present in the pipeline could lead to precipitates, which would interfere with the subsequent operation of the pipeline.

SUMMARY OF THE INVENTION

Compatible mixtures of coal liquids and petroleum fuels of a wide variety of compositions and over a broad range of proportions is achieved by removing or modifying the asphaltene-containing fraction of the coal liquids. After removal or modification of the 950° F. plus fraction from the coal liquid, coal derived liquids, such as SRC, Synthoil and H-Coal can be combined with a variety of petroleum fuels, such as heavy coker gas oil, No. 2 distillate, No. 6 fuel oil and the like, without residue formation.

DESCRIPTION OF SPECIFIC EMBODIMENTS

The compatibility of coal liquids with a wide variety of petroleum fuels is greatly enhanced by removing or modifying the 950° F. plus fraction of the coal liquid. Various conventional processes can be employed for the removal or modification of the coal liquid, such as distillation, deasphalting or hydroprocessing. After removal of the 950° F. plus fraction or modification of this fraction, it is found that the resulting product can be mixed over a wide range of proportions with a wide variety of petroleum fuel fractions.

The coal liquids may be derived from various coal sources and processed by a variety of processes for removing inorganics (ash), heteroatoms and the like and/or for providing a product which is liquid at ambient or moderately elevated temperatures. The coal liquids are those having significant amounts of materials boiling at or above 950° F., which fraction has a substantial proportion of asphaltenes, generally greater than about 25 weight %.

The coal liquids are found to be incompatible with a wide variety of petroleum base fuels. In a study of different coal liquid and petroleum based fuel mixtures, the following results were obtained.

TABLE I[a]

| Petroleum Based Fuel | Residue after Centrifuging (Vol. %) | | |
|---|---|---|---|
| | SRC | Synthoil | H-Coal |
| No. 2 Distillate Fuel | (b) | 18 | 26 |
| No. 6 Fuel Oil | (b) | 50 | 50 |
| Heavy Coke Gas Oil | (b) | 15 | 30 |
| FCC Clarified Slurry Oil | 20 | 0.4 | 20 |

[a]1/1 Blends stirred at 150°-250° F. for 6 hours, then centrifuged at 150°-170° F.
(b) SRC was insoluble From the above results, it is found that none of the blends are compatible for general use. While for boiler fuel use, one standard for the above test is 1.0 vol. %, for diesel fuel use the analogous standard is 0.3 vol. %, which all blends fail.

In accordance with this invention, the modified coal liquids and petroleum based fuels can be mixed to provide a blend which comes within the appropriate standards of compatibility. The mixtures will ordinarily have at least 5 weight percent, more usually at least 10 weight percent of each of the components. Of course, the petroleum based fuel may be a cut from a single source or a blend of different cuts from the same source or different sources. The petroleum based fuel will generally boil above about 250° F., more usually above about 350° F. For the most part, the petroleum based fuels will be mixtures of paraffins, naphthenes and aromatics and substantially free of heterocyclics and asphaltenes.

In order to demonstrate the marked difference in compatibility between coal derived liquids and petroleum based fuels when the coal liquids were modified by removal of the 950° F.+ fraction, the Synthoil and H-Coal were subject to vacuum distillation and the 950° F.− fraction isolated. These fractions were tested for their compatibility in the same manner as previously described. The following table indicates the results.

TABLE II[(a)]

| Petroleum Based Fuel | Residue after Centrifuging (Vol. %) | |
|---|---|---|
| | Synthoil (950° F.−) | H-Coal (950° F.−) |
| No. 2 Distillate Fuel | <0.05 | <0.05 |
| No. 6 Fuel Oil | <0.05 | <0.05 |
| Heavy Coker Gas Oil | <0.05 | <0.05 |

[(a)]1/1 Blends stirred at 150°-250° F. for 6 hours, then centrifuged at 150°-170° F.

All of the blends which were prepared from the 950° F.− fractions were found to be compatible at 1/1 ratios, demonstrating the usefulness of coal liquids as extenders or partial alternates for petroleum based fuels.

The coal liquids are prepared by conventional processing, involving either catalytic or non-catalytic treatment of coal with solvent, normally in the presence of hydrogen as a hydrogen donor solvent or as hydrogen gas. These processes find substantial exemplification in the patent literature. Illustrative patents for the solvent refining of coal include U.S. Pat. Nos. 3,488,278, 3,405,202, 3,536,608, 3,640,816 and 3,692,662. An illustrative patent for H-coal processing is 3,540,995.

In view of the varied and extensive disclosures of the processing of coal, only a very brief description of each of the processes will be given.

In the solvent refining of coal, the feed coal, in a finely divided state and substantially free of extraneous water (MF) (frequently also free of ash (MAF)) is subjected to a hydrogen donor solvent at an elevated temperature. The process is normally conducted at a temperature in the range of about 200°-500° C., a pressure in the range of about 1-6500 psig, a residence time in the range of about 1-120 minutes, and a solvent to coal weight ratio of about 1-4:1. The process is optionally carried out in the presence of hydrogen, with a hydrogen uptake of up to 50 scf per pound of MAF coal. Catalyst may optionally be included. The donor solvent is normally partially hydrogenated polycyclic aromatic hydrocarbons, which may include some oxygenated aromatic compounds. The residence time is usually sufficient to provide from about 50 to 90% conversion of the coal into a soluble product. The resulting product is then transferred from the reactor for further processing.

The "H"-Coal process has been primarily the development of Hydrocarbon Research, Inc. In this process, dry pulverized coal is slurried with process-derived oil to which is added compressed make-up hydrogen. The slurry and hydrogen are heated in a fired preheater before being fed to the base of the catalytic (Co/Mo) ebullated-bed reactor, along with recycled high-pressure gas that is similarly preheated. The catalyst in the reactor is suspended in the ebullated-bed by the additional internal recycle-oil flow provided by the hot-oil recycle pump. The relative sizes of the catalyst and coal are such that only the unconverted coal, ash, liquid and gaseous products leave the reactor, while retaining the catalyst therein. The reactor product slurry is let down at essentially reactor temperature to the atmospheric pressure flash drum in which a portion of the lighter hydrocarbon liquids is flashed-vaporized and fed to the atmospheric distillation tower.

The conditions under which the coal is treated are normally temperatures of about 850° F. and pressures from about 2,000 to 3,000 psi.

The Synthoil process has been developed primarily by the Pittsburg Energy Research Center (PERC) of the United States Energy Research and Development Administration. In this process, pulverized dry coal is slurried in a recycled portion of its own product oil. The slurry is pumped into a catalytic fixed-bed reactor with hydrogen at high velocity to create turbulent flow conditions. The reactor is filled with immobolized catalyst pellets composed of cobalt-molybdate on silica activated alumina. The combined effect of the hydrogen, turbulent flow conditions and catalytic action is to liquefy and desulfurize the coal. Operating conditions within the reactor are about 850° F. and 2,000-4,000 psi and a residence time of about 15 minutes. Subsequent treatment of the product allows for separation of gas from liquid and removal of ash and unreacted coal from the raw oil.

In accordance with this invention, coal liquids from a wide variety of sources and processing can be modified so as to be useful in the preparation of mixtures with a broad spectrum of petroleum based fuels. Thus, coal liquids can be employed for extending petroleum based fuels to provide a product which does not form an undesirable sediment. The resulting mixtures can be used in conventional manners as fuels without concern for the plugging up of lines, values, nozzles and the like due to the incompatibility of the coal liquid and the petroleum based fuel.

Although the foregoing invention has been described in some detail by way of illustration and example for purposes of clarity of understanding, it will be obvious that certain changes and modifications may be practiced within the scope of the appended claims.

What is claimed is:

1. Compatible mixtures of coal liquids and petroleum based fuels boiling above about 250° F. and having at least about 10 weight percent of each of the components wherein said coal liquid is prepared by processing with solvent in the presence of hydrogen as a hydrogen donor solvent or as hydrogen gas and is free of the 950° F.+ fraction as a result of hydroprocessing, deasphalting or distillation.

2. A mixture according to claim 1 wherein said coal liquid is solvent refined coal.

3. A mixture according to claim 1, wherein said coal liquid is Synthoil.

4. A mixture according to claim 1, wherein said coal liquid is H-coal.

5. A mixture according to claim 1, wherein said petroleum based fuel is selected from the group consisting of heavy coker gas oil, No. 6 fuel oil, No. 2 distillate and FCC clarified slurry oil.

* * * * *